US011348458B2

(12) United States Patent
Savla et al.

(10) Patent No.: US 11,348,458 B2
(45) Date of Patent: May 31, 2022

(54) ADAPTIVE TRAFFIC CONTROL

(71) Applicant: UNIVERSITY OF SOUTHERN CALIFORNIA, Los Angeles, CA (US)

(72) Inventors: Ketan Savla, Los Angeles, CA (US); Pouyan Hosseini, Los Angeles, CA (US)

(73) Assignee: UNIVERSITY OF SOUTHERN CALIFORNIA, Los Angeles, CA (US)

( * ) Notice: Subject to any disclaimer, the term of this patent is extended or adjusted under 35 U.S.C. 154(b) by 167 days.

(21) Appl. No.: 16/615,104

(22) PCT Filed: Jun. 8, 2018

(86) PCT No.: PCT/US2018/036759
§ 371 (c)(1),
(2) Date: Nov. 19, 2019

(87) PCT Pub. No.: WO2018/227157
PCT Pub. Date: Dec. 13, 2018

(65) Prior Publication Data

US 2021/0287534 A1 Sep. 16, 2021

Related U.S. Application Data

(60) Provisional application No. 62/517,747, filed on Jun. 9, 2017.

(51) Int. Cl.
*G08G 1/07* (2006.01)
*G08G 1/082* (2006.01)
(Continued)

(52) U.S. Cl.
CPC ..... *G08G 1/082* (2013.01); *G08G 1/0116* (2013.01); *G08G 1/0133* (2013.01); *G08G 1/0145* (2013.01); *G08G 1/08* (2013.01)

(58) Field of Classification Search
CPC .... G08G 1/082; G08G 1/0145; G08G 1/0116; G08G 1/08; G08G 1/0133; G08G 1/083
(Continued)

(56) References Cited

U.S. PATENT DOCUMENTS 5,357,436 A 10/1994 Chiu
8,103,436 B1 1/2012 Chandra et al.
(Continued)

FOREIGN PATENT DOCUMENTS

WO WO2015/159251 10/2015

OTHER PUBLICATIONS

International Search Report and Written Opinion of the International Searching Authority dated Aug. 30, 2018 for Corresponding International PCT Patent Application No. PCT/US18/036759, filed Jun. 8, 2018.

*Primary Examiner* — Anh V La
(74) *Attorney, Agent, or Firm* — Snell & Wilmer LLP

(57) ABSTRACT

The disclosure presents methods and apparatus for adaptive control of one or more traffic signals. A method may include determining an offset value based on a function of a traffic flow performance metric. The method may further include determining a green time split value based on a distributed algorithm. The method may further include adaptive control of the one or more traffic signals based on the green time split value and the offset value.

20 Claims, 6 Drawing Sheets

(51) Int. Cl.
*G08G 1/01* (2006.01)
*G08G 1/08* (2006.01)

(58) Field of Classification Search
USPC ..... 340/913, 914, 907, 911, 909
See application file for complete search history.

(56) References Cited

U.S. PATENT DOCUMENTS

| | | | | |
|---|---|---|---|---|
| 2008/0094250 | A1 | 4/2008 | Myr | |
| 2008/0238720 | A1* | 10/2008 | Lee | G08G 1/081 340/909 |
| 2009/0322561 | A1 | 12/2009 | Morioka et al. | |
| 2013/0099942 | A1* | 4/2013 | Mantalvanos | G08G 1/081 340/910 |
| 2014/0159924 | A1* | 6/2014 | Lee | G08G 1/081 340/907 |
| 2016/0267790 | A1 | 9/2016 | Raamot | |
| 2017/0053529 | A1* | 2/2017 | Yokoyama | G08G 1/0145 |

* cited by examiner

ADAPTIVE TRAFFIC CONTROL

CROSS REFERENCE TO RELATED APPLICATIONS

This application is a U.S. national stage entry under 35 U.S.C. § 371 of International Application No. PCT/US2018/036759 filed Jun. 8, 2018 entitled "ADAPTIVE TRAFFIC CONTROL," which claims priority to and the benefit of U.S. Provisional Application Ser. No. 62/517,747, titled "ADAPTIVE TRAFFIC CONTROL," filed on Jun. 9, 2017, which are incorporated by reference herein in its entirety.

GOVERNMENT LICENSE RIGHTS

This invention was made with United States government support under Contract No. METRANS 14-09 awarded by CALTRANS and Contract No. 1454729 awarded by the National Science Foundation. The United States government has certain rights in this invention.

BACKGROUND

1. Field of the Invention

This specification relates to methods and apparatus adaptive traffic control, and more particularly to real-time offset and green time split control for signalized arterial networks.

2. Description of the Related Art

Recent years have witnessed fast developments in the availability of real-time traffic data at increasingly finer resolutions. Simultaneously, within the context of smart cities, there is a trend to retrofit the transportation infrastructure to utilize this data to be able to control traffic in real-time to improve congestion, reduce carbon footprint, and increase resiliency to traffic incidents. However, corresponding scientific methodologies to exploit these technological advancements in a principled manner are lacking.

Adaptive traffic control systems (ATCS) have been of growing interest in recent years. In the context of the United States, the FHWA developed the ACS Lite system. Worldwide, SCOOT (Split Cycle Offset Optimization Technique) has been incorporated along with ACS Lite system into commercial offerings.

While these adaptive systems have shown improved performance over traditional fixed time control settings, they are not scalable and are difficult to optimize. It is desirable, therefore, to overcome these and other deficiencies of existing methods with new and improved approaches.

SUMMARY OF THE INVENTION

A traffic signal controller for adaptive control of one or more traffic signals is disclosed. The traffic signal controller includes a memory and one or more processors operatively coupled to the memory. The one or more processors configured to determine an offset value based on a traffic flow performance metric; and determine a green time split value based on a distributed algorithm. The one or more processors also configured to control the one or more traffic signals based on the green time split value and the offset value; and obtain measurement data indicating the traffic flow performance metric. The one or more processors also configured to update at least one of the green time split value or the offset value, based on the measurement data.

A method for adaptive control of one or more traffic signals is disclosed. The method includes determining an offset value based on a first traffic flow performance metric; and determining a green time split value based on at least one of the first traffic flow performance metric or a second traffic flow performance metric. The method also includes controlling the one or more traffic signals based on the green time split value and the offset value; and obtaining measurement data indicating at least one of first traffic flow performance metric or the second traffic flow performance metric. The method further includes updating at least one of the first traffic flow performance metric or the function of the second traffic flow performance metric, based on the measurement data.

A system for adaptive control of one or more traffic signals is disclosed. The system includes a first traffic signal controller operatively coupled to a first traffic signal. The system also includes a second traffic signal controller operatively coupled to a second traffic signal, the second traffic signal controller configured to communicate with the first traffic signal controller, the second traffic signal controller having one or more processors. The one or more processors configured to determine an offset value based on a traffic flow performance metric; and determine a green time split value based on a distributed algorithm. The one or more processors also configured to control the one or more traffic signals based on the green time split value and the offset value; and obtain measurement data indicating the traffic flow performance metric. The one or more processors also configured to update at least one of the green time split value or the offset value, based on the measurement data.

BRIEF DESCRIPTION OF THE DRAWINGS

The features and advantages of the embodiments of the present disclosure will become more apparent from the detailed description set forth below when taken in conjunction with the drawings. Naturally, the drawings and their associated descriptions illustrate example arrangements within the scope of the claims and do not limit the scope of the claims. Reference numbers are reused throughout the drawings to indicate correspondence between referenced elements.

DETAILED DESCRIPTION

Figure 1:
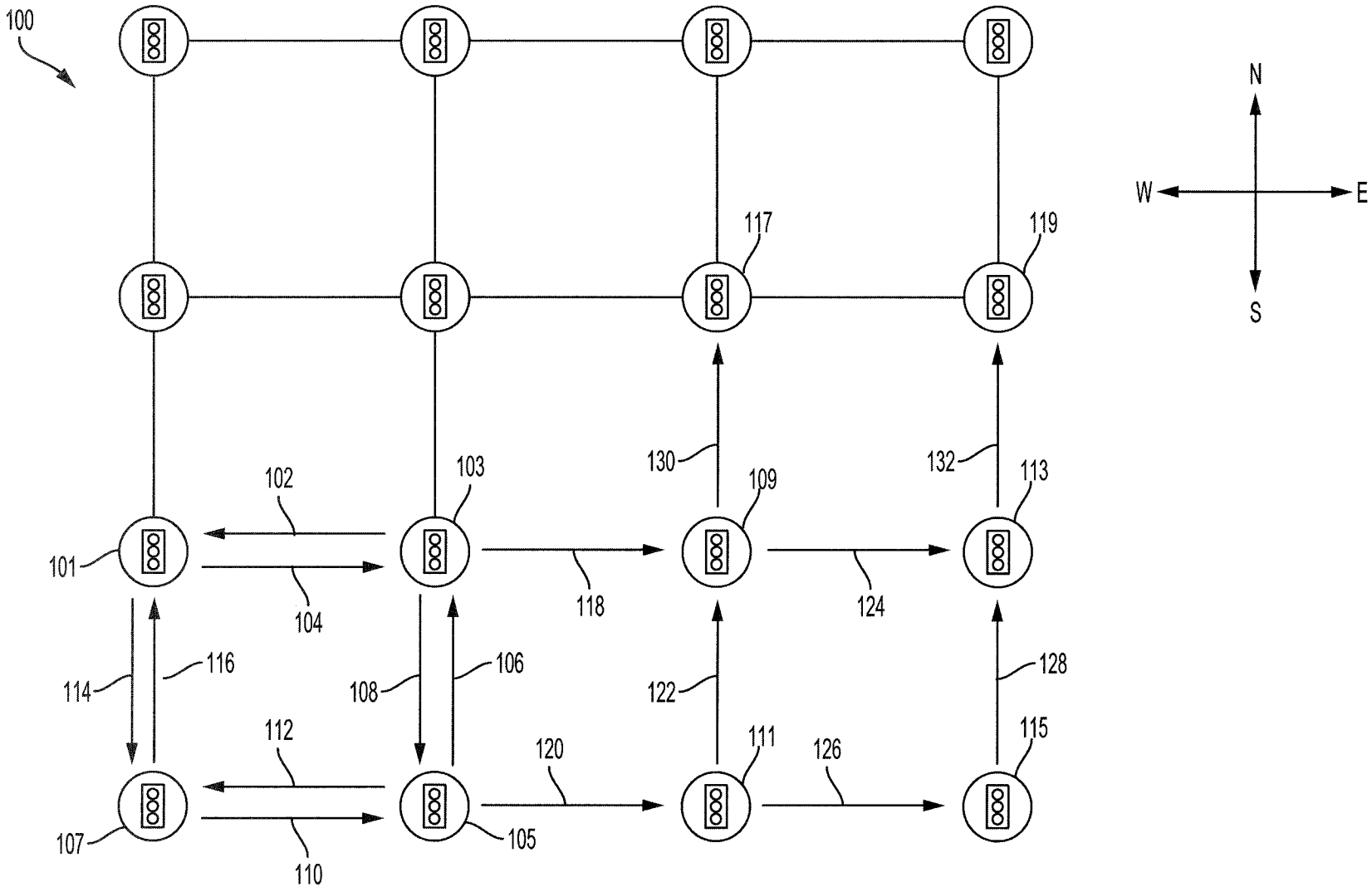
FIG. 1 is a diagram of a network of traffic signals according to an embodiment of the invention.

In the following detailed description, numerous specific details are set forth to provide an understanding of the present disclosure. It will be apparent, however, to one of ordinary skill in the art that elements of the present disclosure may be practiced without some of these specific details. In other instances, well-known structures and techniques have not been shown in detail to avoid unnecessarily obscuring the present disclosure.

One of the largest and most frustrating consequences of living in modern cities is dealing with traffic. Driving to certain locations at various times becomes an increasingly frustrating and time consuming task as a result of traffic. Many people, as a consequence, need to plan their daily routines and activities around traffic patterns, such as peak rush hour.

A traffic signal, for an intersection, will generally have four sides with a green, yellow, and red light on each one of the four sides. Each side of the traffic signal is perpendicular to the side immediately adjacent to it and opposite sides of the traffic signal will display the same color light at the same time. Traffic is largely the result of vehicular volume but is also the result of inefficient control of these traffic signals. For example, a traffic signal may have two sides displaying the green light despite having no vehicles moving through an intersection while the two other sides are displaying red despite having many vehicles stopped at the same intersection.

The control of traffic signals by a computer is already an existing technology that is in widespread use worldwide. However, this current technology is lacking because traffic signals are controlled such that the real-time flow of traffic is not immediately factored in to the control. The methods, apparatuses, and systems disclosed herein are an improvement on that existing computer based traffic signal control technology.

The control of one or more traffic signals involves the use of three interrelated quantities: green time split, offset time, and cycle time. Green time split is the amount of time a traffic signal will remain green. The cycle time is the time between green time splits for a given traffic signal. For example, if a traffic signal is green for 1 minute, yellow for 10 seconds, and red for 50 seconds, then the green time will be 1 minute. The cycle time will be 2 minutes. The offset time is the difference between the timing of when a traffic signal will be green among different traffic signals. For example, if a traffic signal is set to be green at 12:00 pm and the next traffic signal is set to be green at 12:01 pm, then the offset time will be 1 minute.

Several equations, as will be described below, may represent and perform mathematical operations on various traffic performance metrics. The mathematical results, as performed by a computer, may be used to provide optimized values of green time split and offset values in real-time to an apparatus and/or system. Human beings are incapable of performing the necessary algorithmic calculations on measured traffic flow data to a traffic signal in real-time. If a human being were to attempt to perform these mathematical operations, the time taken would be prohibitively long and render the purpose of performing the mathematical operation frustrated, as the traffic signals could not then be adjusted in real-time.

A network may comprise one or more traffic signals used to regulate vehicular traffic. Each traffic signal within the network located at an intersection where two or more roads meet. Each road may include one or more lanes that carry vehicular traffic between the traffic signals and intersections. Two lane roads may be referred to as two-way corridors and single lane roads may be referred to as one-way corridors. Two lane roads allow traffic to move in opposing directions between two adjacent traffic signals. Single lane roads only allow to traffic to move in a single direction between two adjacent traffic signals. The lanes within the network may be described as extending in the North-South and East-West directions. The traffic demands on the network as a function of time may be described by queue length dynamics. Queue length dynamics may itself be described by a standard mass balance equation, as illustrated below, for any time greater than or equal to zero and starting from an initial condition $x(0)=x_0$.

$$\dot{x}_i(t) = \lambda_i(t) + \sum_j R_{ji} z_j(t) - z_i(t), \quad i \in \varepsilon$$

As shown above, the traffic demands on the network at time (t) is described by the vector of queue lengths, $x(t) \in R^{\epsilon}_{+}$, which corresponds to the number of stationary vehicles. The expression $R_{ji}$, denotes the fraction of traffic flow departing lane j that gets routed to lane i. The expression $R_{ji}$, =0 denotes that lane i is not immediately downstream to lane j. The above equation takes into assumption that 1) all of the entries for R are non-negative, 2) all the row sums are upper bounded by 1, and 3) there is at least one row whose row sum is strictly less than one. Finally, in the above equation, $z_i(t)$ denotes the outflow from lane i at time t.

A computation of gradients of cost functions with respect to the offset time and green time splits is illustrated below.

$$\theta_v(k+1) = \theta_v(k) - \alpha_\theta \frac{\partial J}{\partial \theta_v}, \; g_i(k+1) = g_i(k) - \alpha_\theta \frac{\partial J}{\partial g_i}$$

The offset time is represented by $\Theta_v$ and is associated with an intersection v. The green time split is represented by $g_i$ and is associated with a lane i. Finally, in the above equation, J represents the desired performance metric.

The green time split values may also be computed via a distributed algorithm for optimization, which may itself be based on various traffic performance metrics. In some embodiments, the distributed algorithm determines green time split values based on only local queue length measurements from one or more traffic signals. In some embodiments, the distributed algorithm uses a proportionally fair algorithm in its computation of green time split values. The proportionally fair algorithm may have an associated cost function as illustrated in the below equations.

$$\max_{\{\theta_1, \ldots, \theta_r\} \cup \{\theta_0\} \in S_{r+1}} \sum_{j \in [r]} \left( \sum_{i \in \phi_j} x_i \right) \log \theta_j + \kappa \log \theta_0$$

$$\max_{\theta \in S_r} \sum_{j \in [r]} \omega_j(x) \log \theta_j$$

$$\omega_j(x) = \max_{i \in \phi_j} \frac{\bar{x}_i}{c_i}$$

The calculated change in the offset time for a one-way corridor may be determined using any number of methods. In some embodiments, the calculated change in the offset time, in regard to a one-way corridor, may be illustrated by the equations below.

$$\Delta\theta := \theta_N(\phi(j)) - \theta_M(\phi(i))$$

$$\Delta\theta = \begin{cases} \tau_i \bmod T & p_i(t) < \eta \\ -\left(\frac{L_i}{u_i} \bmod T\right) & p_i(t) \geq \eta \end{cases}$$

$$p_i(t) := \frac{x_i(t)}{x_i^c}$$

The length of the lane is represented by L. The free flow travel time of lane i is represented by $\tau_i$. The average speed of a wave along lane i is represented by $u_i$. The wave representing the change in traffic conditions and generally has backward traveling wave velocity. The cycle length time is represented by T. However, other ways of combining $\tau_i$ and $u_i$, to calculate the change in offset time, may be used interchangeably according to various embodiments.

The calculated change in the offset time for a two-way corridor may be determined using any number of methods. In some embodiments, the calculated change in the offset time, in regard to a two-way corridor, may be illustrated by the equations below.

$$\Delta\theta := \theta_N(\phi(j)) - \theta_M(\phi(i))$$

$$\Delta\theta = \begin{cases} \frac{u_i/L_i + \tau_j}{2} \bmod T & p_j(t) < \eta \leq p_i(t) \\ -\left(\frac{\tau_i + u_j/L_j}{2} \bmod T\right) & p_i(t) < \eta \leq p_j(t) \\ 0 & p_j(t) \geq \eta,\ p_i(t) \geq \eta \\ -(\tau_i \bmod T) & p_i(t) < p_j(t) < \eta \\ -(\tau_j \bmod T) & p_j(t) < p_i(t) < \eta \end{cases}$$

$$p_i(t) := \frac{x_i(t)}{x_i^c}$$

The length of the lane is represented by L. The free flow travel time of lane i is represented by $\tau_i$. The average speed of a wave along lane i is represented by $u_i$. However, other ways of combining $\tau_i$ and $u_i$, to calculate the change in offset time, may be used interchangeably according to various embodiments.

The offset time may additionally be optimized by computing the associated average weights or "traffic congestion", based on a general network setting, for the lanes extending in the North-South and East-West directions. The computation of the average weights is illustrated below.

$$\overline{p}_{NS}(t) = \frac{1}{|\varepsilon^{NS}|} \sum_{i \in \varepsilon^{NS}} p_i(t),\ \overline{p}_{EW}(t) = \frac{1}{|\varepsilon^{EW}|} \sum_{i \in \varepsilon^{EW}} p_i(t)$$

The average weight along the North-South and East-West directions are denoted by $P_{NS}$ and $P_{EW}$ respectfully. The lanes along the North-South and East-West directions are denoted by $\varepsilon^{NS}$ and $\varepsilon^{EW}$ respectfully. The resulting optimized selection may be based on selecting the direction with the highest average weight as computed above. While the North-South and East-West directions are discussed herein, the lanes may also extend in other directions interchangeably. For example, the computation of the average weights, as illustrated above, may be adjusted to accommodate lanes extending along the Northeast-Southwest and Northwest-Southeast directions via a combination of North-South and East-West oriented lanes. Conventional methods for adjusting traffic signal patterns merely address single directions, and are incapable of optimizing the traffic flow of a lane having a combination of orientations (i.e. diagonal directions).

Assuming no change in cycle in time, whenever a change in offset from one value to another is to occur, the green time split value will be impacted as a consequence. In order to compensate for this, the green time split value will need to be changed whenever the offset is transitioned from one value to another; this process is referred to as offset transitioning.

The optimum offset time may also be calculated based on the combination of free flow travel time and the wave speed. The free flow travel time represents the flow of traffic without any traffic conditions that would result in vehicles slowing down. For example, the free flow travel time is highest for an empty one-way corridor whose associated traffic signal remains green. The optimized combination of the free flow travel time and the wave speed for a given traffic signal may be determined based on the degree of spill back for its associated intersection and traffic signal. Spill back occurs when all the space on a lane is occupied by vehicles such that even with a green light vehicles could not advance further on the lane.

FIG. 1 is a diagram of a network 100 of traffic signals according to some embodiments of the invention. The four cardinal navigational points, North, East, South, and West, are depicted for spatial reference.

The network 100 of traffic signals includes more than one traffic signal used to regulate vehicular traffic. Sixteen traffic signals are depicted in FIG. 1, but any number of traffic signals may form the network 100. Each of the traffic signals is located at an intersection where two or more roads meet. Each road may include one or more lanes that carry vehicular traffic between the traffic signals and intersections.

Each of the traffic signals may include one or more traffic signal controllers in communication with each other for controlling the traffic signals at each intersection. Each traffic signal controller may be situated locally or remotely with respect to their corresponding traffic signal. Each traffic signal controller may be in communication with one or more sensors. The one or more sensors may comprise at least one of static traffic sensors, buried traffic sensors, roadside traffic sensors, or traffic cameras. The static traffic sensors may be piezoelectric sensors that detect a passing vehicle by being physically compressed. The buried traffic sensors may be magnetic sensors that detect the changing magnetic field as a vehicle passes over it. The roadside traffic sensors may be acoustic sensors that detect the sound of the passing vehicle. The traffic cameras may allow manual counting of vehicles.

In some embodiments, a traffic signal controller may control more than one traffic signal. In some embodiments, an entire network, similar to the network 100, may be controlled by a single traffic signal controller. In other embodiments, each traffic signal within a network may have its own associated traffic signal controller.

As depicted, there are two lane roads or "two-way corridor" and there are single lane roads or "one-way corridor". Two lane roads allow traffic to move in opposing directions between two adjacent traffic signals (e.g., 102 and 104 or 110 and 112). Single lane roads only allow traffic to move in a single direction between two adjacent traffic signals (e.g., 118 or 124). Each two lane road within the network 100 includes a downstream lane and an upstream lane. The traffic moving on a downstream lane would move in the opposite direction as the traffic moving on an upstream lane.

Lane 104 connects the traffic signal 101 to the downstream traffic signal 103 in a direction moving from West to East. Lane 102 connects the traffic signal 101 to the upstream traffic signal 103 in a direction moving from East to West. Lane 108 connects the traffic signal 103 to the downstream traffic signal 105 in a direction moving from North to South. Lane 106 connects the traffic signal 103 to the upstream traffic signal 105 in a direction moving from South to North. Lane 112 connects the traffic signal 105 to the downstream traffic signal 107 in a direction moving from East to West. Lane 110 connects the traffic signal 105 to the upstream traffic signal 107 in a direction moving from West to East. Lane 116 connects the traffic signal 107 to the downstream traffic signal 101 in a direction moving from South to North. Lane 114 connects the traffic signal 107 to the upstream traffic signal 101 in a direction moving from North to South.

Lane 118 connects the traffic signal 103 to the downstream traffic signal 109 in a direction moving from West to East. Lane 124 connects the traffic signal 109 to the downstream traffic signal 113 in a direction moving from West to East. Lane 130 connects the traffic signal 109 to the downstream traffic signal 117 in a direction moving from South to North. Lane 132 connects the traffic signal 113 to the downstream traffic signal 119 in a direction moving from South to North. Lane 120 connects the traffic signal 105 to the downstream traffic signal 111 in a direction moving from West to East. Lane 126 connects the traffic signal 111 to the downstream traffic signal 115 in a direction moving from West to East. Lane 122 connects the traffic signal 111 to the downstream traffic signal 109 in a direction moving from South to North. Lane 128 connects the traffic signal 115 to the downstream traffic signal 113 in a direction moving from South to North.

Traffic may follow a straight line path. The straight line path may be an upstream chain of traffic signals or a downstream chain of traffic signals. For example, traffic may flow from traffic signal 101 to traffic signal 109 via lanes 104 and 118. Traffic may also follow a diagonal path. For example, traffic may flow from traffic signal 101 to traffic signal 117 via lanes 104, 118, and 130.

Measurement data may be taken by one or more sensors at their associated traffic signals according to various embodiments of the invention. The measurement data may be in the form of quantity of vehicles waiting or passing through the intersection. The measurement data may also be in the form of the amount of time the vehicles have been waiting at the intersection. The measurement data may be provided in real-time to upstream nodes and their associated traffic signals in order to update the green time split values and offset values for its associated traffic signal/intersection. For example, in regard to traffic flowing on lane 114, the measurement data taken at traffic signal 107, by a sensor, may be used to generate new green time split values and offset values in real-time for the upstream traffic signal 101. Similarly, in regard to traffic flowing on lane 116, the measurement data taken at traffic signal 101 may be used to generate new green time split values and offset values in real-time for the upstream traffic signal 107.

The measurement data at a given traffic signal may be exchanged with the measurement data taken at adjacent traffic signals. For example, the measurement data at traffic signal 105 may be exchanged with the measurement data taken at traffic signals 107, 103, and 111. In other embodiments, the measurement data at a given traffic signal may be exchanged with any number of neighboring traffic signals within the network.

The new green time split values and offset values may be generated within a single cycle time or within a discrete number of cycle times. For example, the new green time split values and the offset values may be generated for the next upcoming green light for a given traffic signal, within one cycle time. In another example, the new green time split values and offset values may be generated after two green lights for a given traffic signal, within two cycle times. In yet another example, the new green time split values and offset values may be generated multiple times within a single cycle.

In some embodiments, the new green time split values and the new offset values may be generated after a given traffic signal and one or more neighboring traffic signals have exchanged measurement data within a single cycle time. In other embodiments, the new green time split values or the new offset values may be generated after the given traffic signal and the one or more neighboring traffic signals have exchanged measurement data over multiple cycle times. In another example, the green time split values or the new offset values may be generated multiple times within a single cycle, and the one or more neighboring traffic signals may exchange measurement data multiple times within a single cycle.

The new green time split values and offset values for a given traffic signal may be exchanged with the green time split values and offset values associated with one or more adjacent traffic signals. For example, the green time split values and offset values for traffic signal 105 may be exchanged with the green time split values and offset values for traffic signals 107, 103, and 111. In other embodiments, the green time split values and offset values for a given traffic signal may be exchanged with any number of neighboring traffic signals within the network.

In some embodiments, the new green time split values and the new offset values may be implemented for a given traffic signal after the given traffic signal and one or more neighboring traffic signals have exchanged green time split values and offset values within a single cycle time. In other embodiments, the new green time split values and the new offset values may be implemented for a given traffic signal after the given traffic signal and one or more neighboring traffic signals have exchanged green time split values and offset values over multiple cycle times.

In some embodiments, the measurement data may be data distributed from one or more third-party measuring components. The third party measuring components may include client devices and servers for mobile navigational nodes such as the ones used in mobile phones, automobile navigational system, or any other similar system. For example, an automobile navigational system may produce a broadcasting signal disclosing the location of the associated automobile. The measurement data, in such a scenario, may be a collection of broadcasting signals from such navigational systems that discloses the number and locations of vehicles waiting at the traffic signal.

In some embodiments, measurement data may be provided in real-time to multiple upstream traffic signals. For example, in regard to traffic flowing on lane 108, measurement data taken at traffic signal 105 may be used to generate new green time split values and offset values in real-time for the upstream traffic signals 103 and 101. Similarly, in regard to traffic flowing on lane 106, measurement data taken at traffic signal 103 may be used to generate new green time split values and offset values in real-time for the upstream traffic signals 105 and 107. The new green time split values and offset values may be generated within a single cycle time or within a discrete number of subsequent cycle times.

Measurement data may also be provided to traffic signals anywhere along the upstream chain of traffic signals. For example, in regard to traffic flowing on lane 110, measurement data taken at traffic signal 105 may be used to generate new green time split values and offset values in real-time to upstream traffic signal 101. Similarly, in regards to traffic flowing on lane 112, measurement data taken at traffic signal 107 may be used to generate new green time split values and offset values in real-time to upstream traffic signal 103.

Measurement data may also be provided to traffic signals along a diagonal path of traffic signals. For example, in regards to traffic flowing on lane 118, measurement data taken at traffic signal 109 may be used to generate new green time split values and offset values in real-time to traffic signal 117. Similarly, in regards to traffic flowing on lane 124, measurement data taken at traffic signal 113 may be used to generate new green time split values and offset values in real-time to traffic signal 119.

In some embodiments, the measurement data taken at a particular traffic signal may be used to generate new green time split values for both upstream and downstream traffic signals. In some embodiments, the measurement data taken at a particular traffic signal may be used to generate new green time split values for traffic signals along a upstream, downstream, and diagonal path. In other embodiments, the measurement data taken at a particular traffic signal may be used to generate new green time split values only for downstream traffic signals.

The traffic signal controllers may communicate with each other via a peer-to-peer (PSP) system. In other embodiments, the traffic signal controllers may communicate with each other via other system such as a virtual private network (VPN) operating over a public wide area network (WAN). However, any other form of communication network may be used interchangeably. The traffic signal controllers may communicate with each other by sending and receiving the measurement data using a dedicated short range communication (DSRC) receiver. The traffic signal controllers themselves may be situated locally or remotely with respect to their corresponding intersection.

The measurement data may comprise one or more traffic performance metrics which may represent the quantity of vehicles at an intersection or the amount of time the vehicles have been waiting at an intersection. The traffic performance metrics may be the traffic queue length representing the length or volume of vehicular traffic per lane. The traffic queue length may comprise a measurement of the traffic queue length averaged over the intersections of the network 100. The traffic queue length may be based on a fluid model. In some embodiments, the system optimizes traffic flow efficiency using one or more gradients of a cost function. The cost function representing the cost in time or number of vehicles associated with a change in the timing of either the green time split time or the offset time. In other embodiments, the system optimizes traffic flow efficiency using a distributed algorithm based on various traffic performance metrics. In some embodiments, the distributed algorithm may take only local queue length measurements from one or more traffic signals in its computation of green time split values. In some embodiments, the distributed algorithm may use a proportionally fair algorithm. The proportionally fair algorithm representing the competing interest for the multiple lanes of traffic at given intersection.

In some embodiments, the measurement data may comprise a function of a traffic performance metric. The function of the traffic performance metric may comprise one or more gradients taken with respect to the traffic performance metric used for calculating the green time split value. The gradients may the same gradients of cost functions mentioned and illustrated herein. In other embodiments, the function of the traffic flow performance comprises one or more gradients taken with respect to a traffic performance metric not used for calculating the green time split value.

In some embodiments, the calculated green time split value may be based on historical data and traffic measurements. In some embodiments, the calculated offset value may similarly be based on historical data and traffic measurements. In other embodiments, the change in green time split may be based on the change in the offset time. In other embodiments, both the calculated green time split value and the offset value may be based on historical data and traffic measurements. In some embodiments, the green time split value may be changed whenever the offset is transitioned from one value to another. In other embodiments, the offset time may be optimally calculated based on free flow travel time and the wave speed. The combination of the free flow travel time and the wave speed for a given traffic signal may be determined by the degree of spill back for the intersection associated with the given traffic signal.

Figure 2:
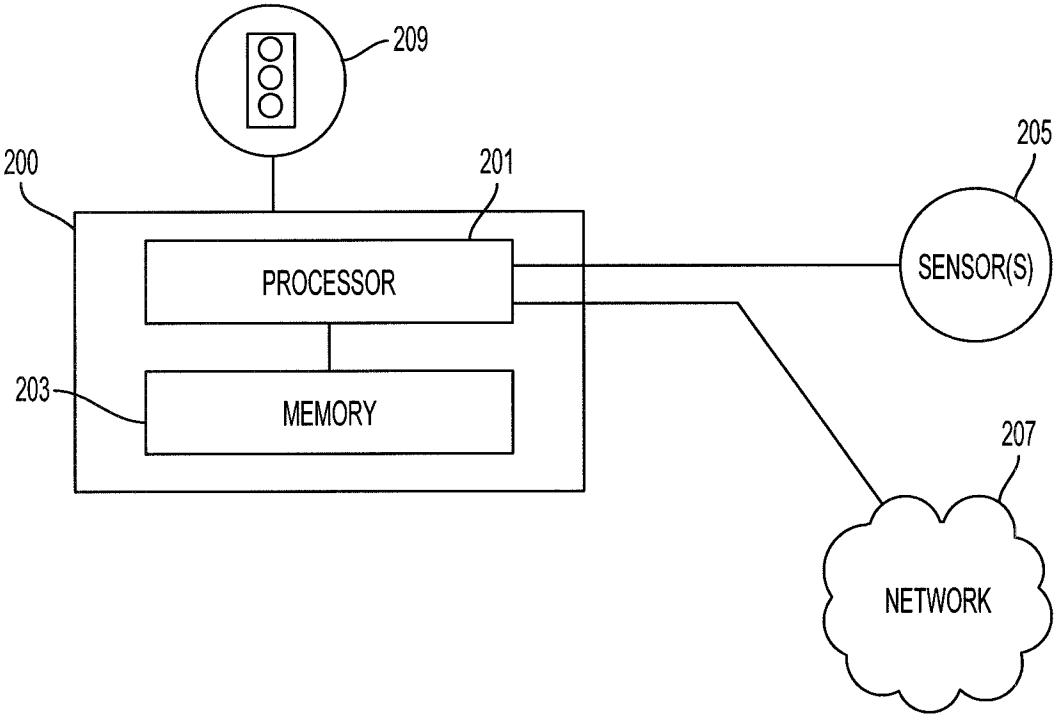
FIG. 2 is a block diagram of a traffic signal controller for adaptive control of one or more traffic signals according to an embodiment of the invention.

FIG. 2 is a block diagram of a traffic signal controller 200 for adaptive control of one or more traffic signals according to an embodiment of the invention.

The traffic signal controller 200 includes a processor 201 and a memory 203 in operable communication with the processor 201. The traffic signal controller 200 may be in operable communication with one or more traffic signals 209. The processor 201 may be in operable communication with one or more sensors 205 and/or a network 207. In some embodiments, the traffic signal controller 200 may be configured to function similarly as any of the traffic controllers associated with traffic signals 101, 103, 105, or 107 as depicted in FIG. 1.

In some embodiments, the network 207 may be itself in operable communication with the sensors 205. In some embodiments, the network 207 may be in operable communication with other traffic signal controllers similar to traffic signal controller 200.

The memory 203 may be a non-transitory memory and may include instructions for the processor 201 to perform operations on measured data received from the one or more sensors 205. The memory 203 may similarly include instructions for the processor 201 to perform operations on measured data received from the network 207 in operable communication with one or more sensors 205. In some embodiments, the memory may be configured to store historical data in the form of previously measured traffic flow metrics received by the one or more sensors 205 and/or the network 207.

The measured data may be in the form of traffic performance metrics. The traffic performance metrics may be based on the traffic queue length. The traffic queue length may comprise a measurement of the traffic queue length averaged over one or more intersections. The traffic queue length may be based on a fluid model. Because human beings are incapable of providing the necessary algorithmic calculations on measured traffic flow data to a traffic signal in real-time, the mathematical calculations are necessarily performed by a processor.

In some embodiments, the traffic performance metrics may be based on one or more gradients of a cost function.

In other embodiments, the system optimizes traffic flow efficiency using a distributed algorithm based on various traffic performance metrics. In some embodiments, the distributed algorithm may take only local queue length measurements from one or more traffic signals in its computation of green time split values. In some embodiments, the distributed algorithm may use a proportionally fair algorithm. The proportionally fair algorithm represents the competing interest for the multiple lanes of traffic at given intersection. As described herein, the computation of gradients of cost functions with respect to the offsets and green time splits is illustrated below:

$$\theta_v(k+1) = \theta_v(k) - \alpha_\theta \frac{\partial J}{\partial \theta_v},\ g_i(k+1) = g_i(k) - \alpha_\theta \frac{\partial J}{\partial g_i}$$

In some embodiments, the operations performed by the processor 201 may be in the form of applying a function of a traffic flow performance metric. The function of a traffic flow performance metric may comprise one or more gradients taken with respect to a traffic performance metric used for calculating the green time split value. In other embodiments, the function of a traffic flow performance comprises one or more gradients taken with respect to a traffic performance metric not used for calculating the green time split value. For example, the green split value may be calculated based on a proportionally fair algorithm, whereas the offset value is based traffic queue length.

In some embodiments, the calculated green time split value may be based on historical data and traffic measurements. In some embodiments, the calculated offset value may be based on historical data and traffic measurements. In other embodiments, both the calculated green time split value and the offset value may be based on historical data and traffic measurements. In other embodiments, the change in green time split may be based on the change in the offset time. In some embodiments, the green time split value may be changed whenever the offset is transitioned from one value to another. In other embodiments, the offset time may be optimally calculated based on free flow travel time and the wave speed. The combination of the free flow travel time and the wave speed for a given traffic signal may be determined by the degree of spill back for the intersection associated with the given traffic signal.

After the processor 201 has performed operations on the measured data to calculate a new green time split value and a new offset value, the processor 201 may then update the green time split value and the offset value. The green time split value and the offset value may be stored in the memory 203. The processor 201 may communicate the updated green time split value and the offset value to a separate traffic controller in communication with the traffic signal 209 for implementation. In other embodiments, the processor 201 may provide the implementation of the new green time split value and the new offset value at the traffic signal 209 by controlling the traffic signal 209. Again, because human beings are incapable of providing the necessary algorithmic calculations on measured traffic flow data to a traffic signal in real-time, the mathematical calculations are necessarily performed by a processor.

Traffic signal 209 may communicate directly with the traffic signal controller 200 according to some embodiments. In other embodiments, traffic signal 209 may communicate with other traffic signal controllers and/or with the network 207.

Figure 3:
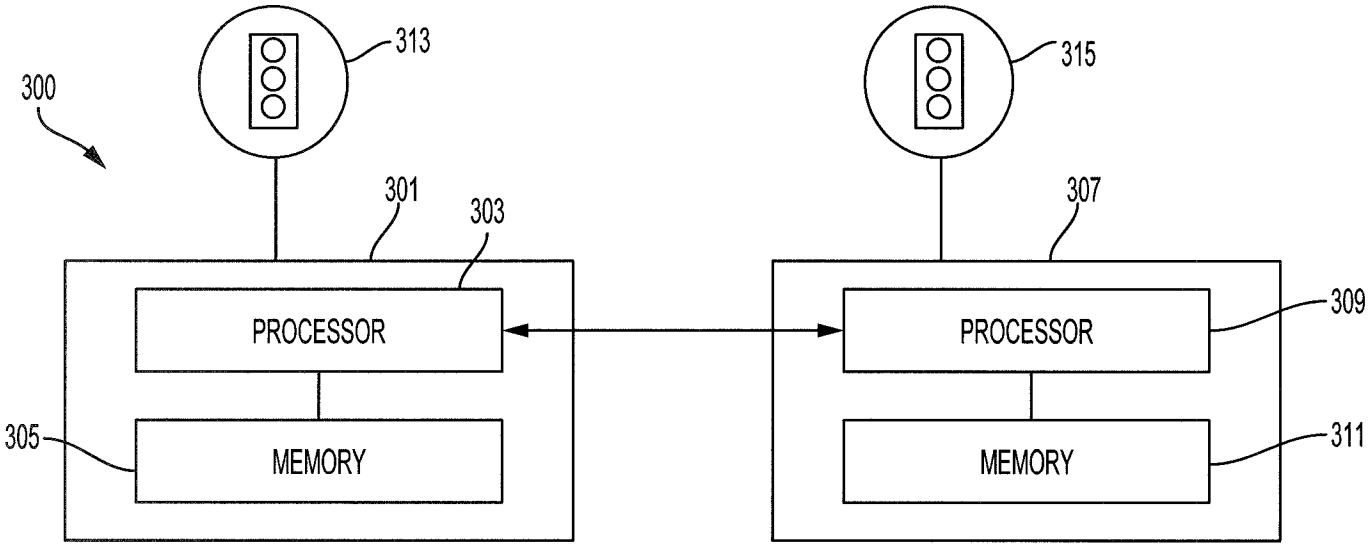
FIG. 3 is a block diagram of a system for adaptive control of traffic signals according to an embodiment of the invention.

FIG. 3 is a block diagram of a system 300 for adaptive control of traffic signals according to an embodiment of the invention.

The system 300 includes a first traffic signal controller 301 and a second traffic signal controller 307. The first traffic signal controller 301 includes a first processor 303 and a first memory 305 in operable communication with the processor 303. The second traffic signal controller 307 includes a second processor 309 and a second memory 311 in operable communication with the second processor 309. The first processor 303 and the second processor 309 are in operable communication with each other. In some embodiments, the system 300 may be configured to function similarly as any two of the traffic signal controllers associated with traffic signals 101, 103, 105, or 107 as depicted in FIG. 1.

The first traffic signal controller 301 may be in operable communication with a first traffic signal 313. The second traffic signal controller 307 may similarly be in operable communication with a second traffic 315. In some embodiments, the first traffic signal controller 301 may be in operable communication with both the first traffic signal 313 and the second traffic signal 315. Similarly, in some embodiments, the second traffic signal controller 307 may be in operable communication with both the second traffic signal 315 and the first traffic signal 313.

In some embodiments, the first processor 303 and the second processor 309 may be in direct communication with each other via respective transceivers. In other embodiments, the first processor 303 and the second processor 309 may each be in direct communication with a network, similar to network 207 in FIG. 2, with the network facilitating communication between the first processor 303 and the second processor 309.

The first memory 305 may include instructions for the first processor 303 to perform operations on measured data received from the second traffic signal controller 307. The second memory 311 may similarly include instructions for the second processor 309 to perform operations on measured data received from the first traffic signal controller 301. In some embodiments, the first memory 305 and the second memory 311 may be configured to store historical data in the form of previously measured traffic flow metrics.

The measured data may be in the form of traffic performance metrics. The traffic performance metrics may be based on in whole or in part the traffic queue length. The traffic queue length may comprise a measurement of the traffic queue length averaged over intersections. The traffic queue length may be based on a fluid model.

The traffic performance metrics may be based on various functions. In some embodiments, the traffic performance metric may be based on one or more gradients of a cost function. In other embodiments, the system optimizes traffic flow efficiency using a distributed algorithm based on various traffic performance metrics. In some embodiments, the distributed algorithm may take only local queue length measurements from one or more traffic signals in its computation of green time split values. In some embodiments, the distributed algorithm may use a proportionally fair algorithm. The proportionally fair algorithm representing the competing interest for the multiple lanes of traffic at given intersection. As described herein, the computation of gradients of cost functions with respect to the offsets and green time splits is illustrated below:

$$\theta_v(k+1) = \theta_v(k) - \alpha_\theta \frac{\partial J}{\partial \theta_v},\ g_i(k+1) = g_i(k) - \alpha_\theta \frac{\partial J}{\partial g_i}$$

In some embodiments, the operations performed by the first processor 303 and the second processor 309 may be in the form of applying a function of a traffic flow performance metric. The function of a traffic flow performance metric may comprise one or more gradients taken with respect to a traffic performance metric used for calculating the green time split value. In other embodiments, the function of a traffic flow performance comprises one or more gradients taken with respect to a traffic performance metric not used for calculating the green time split value.

In some embodiments, the calculated green time split value may be based on historical data and traffic measurements. In some embodiments, the calculated offset value may be based on historical data and traffic measurements. In other embodiments, both the calculated green time split value and the offset value may be based on historical data and traffic measurements. In some embodiments, the green time split value may be changed whenever the offset is transitioned from one value to another. In other embodiments, the offset time may be optimally calculated based on free flow travel time and the wave speed. The combination of the free flow travel time and the wave speed for a given traffic signal may be determined by the degree of spill back for the intersection associated with the given traffic signal. In other embodiments, the change in green time split may be based on the change in the offset time.

After the first processor 303 has performed operations on the measured data to calculate a new green time split value and a new offset value, the first processor 303 may then update the green time split value and the offset value for the first traffic signal 313. The first processor 303 may then communicate the updated green time split value and the offset value to the first traffic signal 313 for implementation. In other embodiments, the first processor 303 may communicate the updated green time split value and the offset value to the second processor 309 for implementation. In some embodiments, the first processor 303 may provide the implementation of the new green time split value and the new offset value at the first traffic signal 313 by controlling the traffic signal 313.

Similarly, after the second processor 309 has performed operations on the measured data to calculate a new green time split value and a new offset value, the second processor 309 may then update the green time split value and the offset value for the second traffic signal 315. The second processor 309 may then communicate the updated green time split value and the offset value to the second traffic signal 315 for implementation. In other embodiments, the second processor 309 may communicate the updated green time split value and the offset value to the first processor 303 for implementation. In some embodiments, the second processor 309 may provide the implementation of the new green time split value and the new offset value at the second traffic signal 315 by controlling the second traffic signal 315.

Figure 4:
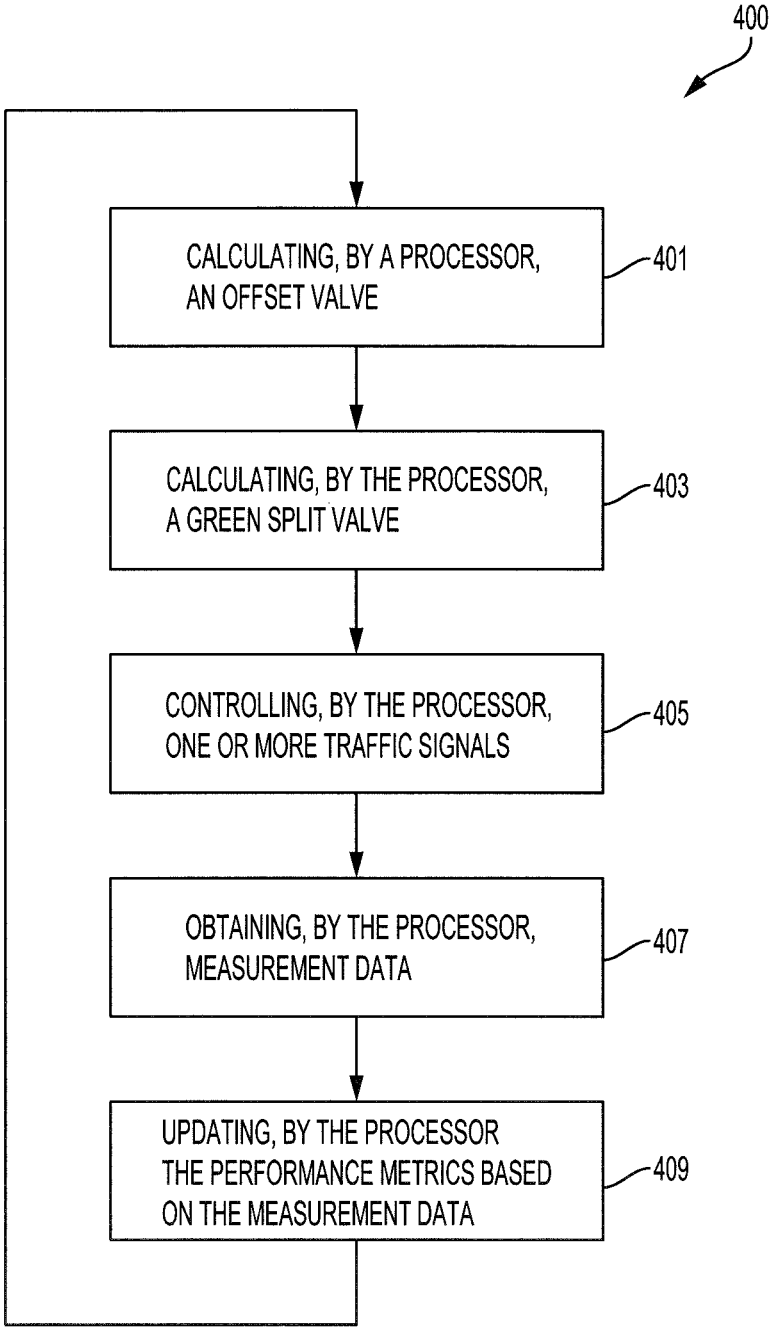
FIG. 4 is a flowchart illustrating aspects of a method for adaptive control of one or more traffic signals.

FIG. 4 is a flowchart illustrating aspects of a method 400 for adaptive control of one or more traffic signals. The method 400 may be implemented by either an apparatus similar to the one in FIG. 2 or the system in FIG. 3.

A processor (e.g., processor 201, 303, or 309) may calculate an offset value (Step 401). In particular, the processor may determine the offset value by performing mathematical operations on received measured data. These mathematical operations must be performed by a computer in order to be sufficiently responsive to the time-sensitive nature of the changes in traffic conditions. The measured data may be received from a sensor or another traffic signal controller. The mathematical operations may be based on instructions stored in a memory in operable communication with the processor. As depicted in FIG. 4, the calculation of an offset value is a separate step, however in other embodiments the calculation of the offset value may occur during or after the calculation of the green split value.

The offset value may be based on one or more traffic flow performance metrics. The traffic performance metrics may be based on in whole or in part the traffic queue length. The traffic queue length may comprise a measurement of the traffic queue length averaged over intersections. The traffic queue length may be based on a fluid model.

In some embodiments, the traffic performance metric may be based on one or more gradients of a cost function. In other embodiments, the optimized traffic flow is performed by a distributed algorithm based on various traffic performance metrics. In some embodiments, the distributed algorithm may take only local queue length measurements from one or more traffic signals in its computation of green time split values. In some embodiments, the distributed algorithm may use a proportionally fair algorithm. In some embodiments the offset value may be based on a function of a traffic performance metric. The function of a traffic flow performance metric may comprise one or more gradients taken with respect to a traffic performance metric used for calculating the green time split value. In other embodiments, the function of a traffic flow performance comprises one or more gradients taken with respect to a traffic performance metric not used for calculating the green time split value. In some embodiments, the calculated offset value may be based on historical data and traffic measurements. In some embodiments, the green time split value may be changed whenever the offset is transitioned from one value to another. In other embodiments, the offset time may be optimally calculated based on free flow travel time and the wave speed. The combination of the free flow travel time and the wave speed for a given traffic signal may be determined by the degree of spill back for the intersection associated with the given traffic signal. In other embodiments, the change in green time split may be based on the change in the offset time.

The processor may then calculate a green time split value (Step 403). In particular, the processor may determine the green time split value by performing mathematical operations on received measured data. The mathematical operations may be based on instructions stored in the memory in operable communication with the processor. As described above, the calculation of the green time split value may occur before or during the calculation of the offset value. The green split value is based on a traffic flow performance metric that is similarly described above for the calculation of the offset value.

The processor may then control one or more traffic signal (e.g., traffic signals 209, 313, or 315) based on the calculated offset value and the calculated green split value in steps 401 and 403 (Step 405). The control of one or more traffic signals may be in the form of sending instructions to a separate traffic signal controller associated with the one or more traffic signals, or by directly controlling a traffic signal.

The processor may then obtain measurement data (Step 407) from one or more sensors. The measurement data (traffic performance metrics) may be based on in whole or in part the traffic queue length. The traffic queue length may comprise a measurement of the traffic queue length averaged over intersections. The traffic queue length may be based on a fluid model. In some embodiments, the traffic performance metric may be based on one or more gradients of a cost function. In other embodiments, the optimized traffic flow is performed by a distributed algorithm based on various traffic performance metrics. In some embodiments, the distributed algorithm may take only local queue length measurements from one or more traffic signals in its computation of green time split values. In some embodiments, the distributed algorithm may use a proportionally fair algorithm.

The processor may then update the performance metrics based on the measurement data (Step 409). The updating of the performance metrics may be in the form of updating data stored in the memory on an apparatus or a portion of a system. The updating of the performance metrics may be in the form of sending the data directly to a processor in a separate traffic signal controller or be processed by the processor in steps 401 and 403.

After the completion of step 409 the process may then cycle back to step 401 to be repeated. The cycles may be performed a discrete number of times or indefinitely as part of a continuous loop.

Performing the above steps with the mentioned components is not routine/conventional or well-known in the field of computerized automated traffic control technology. In addition, the above steps improve the performance and efficiency of the computerized automatic traffic control method. The presented methods, apparatuses, and systems improve existing computer processes by providing real-time control of traffic signals in response to real-time changing traffic conditions.

Figure 5:
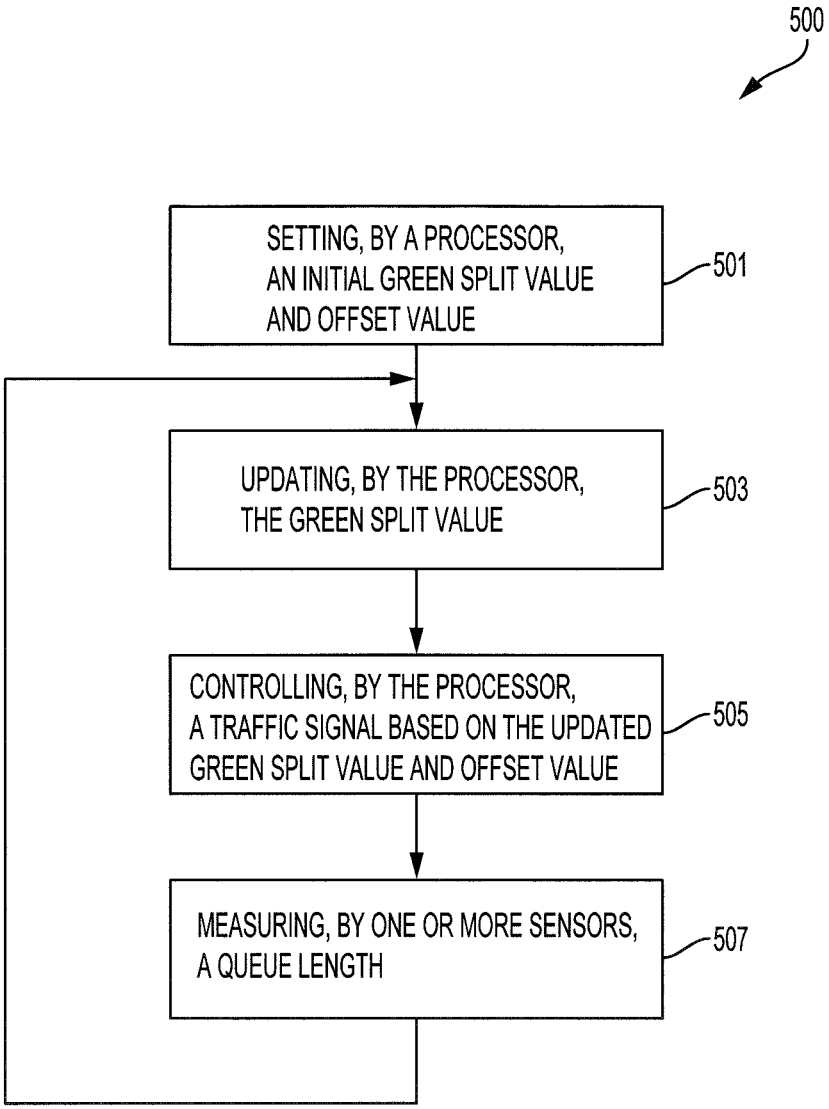
FIG. 5 is a flowchart illustrating aspects of a method for adaptive control of one or more traffic signals.

FIG. 5 is a flowchart illustrating aspects of a method 500 for adaptive control of one or more traffic signals. The method 500 may be implemented by either an apparatus similar to the one in FIG. 2 or the system in FIG. 3.

A processor, similar to the ones disclosed in FIGS. 2-4, may set an initial green split value and offset value (Step 501). The initial green split value and offset value may be based on historical data and traffic measurements stored in a memory. The initial green split value and offset value may be based on an instantaneous measurement of a performance metric. The initial green time split value and offset value may also be obtained from existing fixed-time schedules, may be chosen arbitrarily, or may be obtained from the output of an existing technology such as SCOOT or ACS Lite. In other embodiments, the initial green split value and offset value may be an initializing value stored in the memory used to provide starting conditions that will be adapted in real-time in the subsequent steps.

The processor may receive a measured queue length resulting from subsequent Step 507. The queue length may comprise a measurement of the traffic queue length averaged over intersections. The queue length may be measured by using any one or more suitable measuring methods.

Upon receiving the measured queue length the processor may update the green time split value and the offset value (Step 503). In some embodiments, the calculated green time split value may be based on historical data. In some embodiments, the calculated offset value may be based on historical data. In other embodiments, both the calculated green time split value and the offset value may be based on historical data. In some embodiments, the green time split value may be changed whenever the offset is transitioned from one value to another. In other embodiments, the offset time may be optimally calculated based on free flow travel time and the wave speed. The combination of the free flow travel time and the wave speed for a given traffic signal may be determined by the degree of spill back for the intersection associated with the given traffic signal. In other embodiments, the change in green time split may be based on the change in the offset time.

The processor may then implement the updated green time split value and the offset value (Step 505). The implementation of the updated green time split value and the offset value may be in the form of sending instructions to a traffic single controller or by directly controlling a traffic signal.

After implementing the updated green time split value and the offset value, the resulting queue length may be measured (Step 507). The measurement may be performed by a traffic signal controller or by one or more sensors. In other embodiments, the measurement may be performed using any one or more suitable measuring methods.

After the completion of step 507 the process may then cycle back to step 503 to be repeated. The cycles may be performed in a discrete number or part of a continuous loop.

Figure 6A:
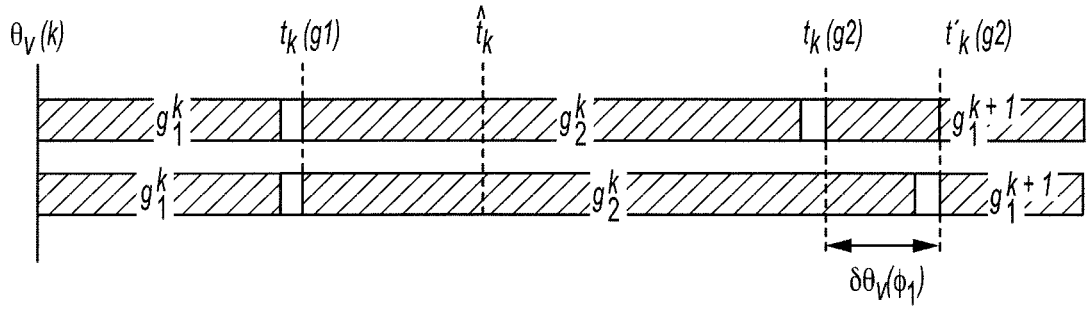
FIG. 6A is an illustration of green time split values before and after implementing a new offset value according to an embodiment of the invention.

FIG. 6A is an illustration of green time split values before and after implementing a new positive offset value according to an embodiment of the invention.

A novel way of implementing green split values and offset values is described herein. The offset transitioning and green split implementation for a given intersection, v, is illustrated below. The green time split value and the offset values may be obtained or determined using any methods and are not limited to those described herein.

```
input: green split candidates: g_1^k, g_2^k
    change of offset: δθ_v(φ1) ∈ (−T/2, T/2)
Modify the green splits as follows:
if δθ(φ_1) > 0 then
  t'_k(g_2) = t_k(g_2) + δθ_v(φ_1) ;
else
  if t_k(g_2) − t̂_k > |δθ(φ_1)| then
    t'_k(g_2) = t_k(g_2) + δθ(φ_1) + T𝟙_{g_2^k<|δθ(φ_1)|};
  else
    t'_k(g_2) = t_k(g_2) + δθ(φ_1) + T;
  end
end
```

The offset time is represented by $\theta_v(k)$ and is associated with an intersection v. The change in the offset time is represented by $\delta\theta_v(\phi 1)$. The green time split values are represented by $g_1^k$, $g_2^k$, and $g_1^{k+1}$. The gaps between the green time split values represent the offset time $\theta_v(k)$. The time associated with the green time split values are represented by $t_k(g1)$, $t_k(g2)$, and $t'_k(g2)$. The positive direction moves in the right direction. The negative direction moves in the left direction. The time at which the offset value is updated is represented by $\hat{t}k$.

The top row illustrates the green time split values, $g_1^k$, $g_2^k$, and $g_1^{k+1}$, before the implementation of the new offset time. The bottom row illustrates the green time split values, $g_1^k$, $g_2^k$, and $g_1^{k+1}$, after implementing the new offset time.

If the change in the offset time, $\delta\theta_v(\phi 1)$, is greater than zero, then the new green time split value, $t'_k(g2)$, modified to equal the old green time split value, $t_k(g2)$, plus the change in the offset time, $\delta\theta_v(\phi 1)$, as illustrated in FIG. 6A. This modification has the overall effect of increasing the green time $g_2^k$. If the change in the offset time, $\delta\theta_v(\phi 1)$, is not greater than zero then the modification of the green time split value depicted in FIG. 6B is implemented.

Figure 6B:
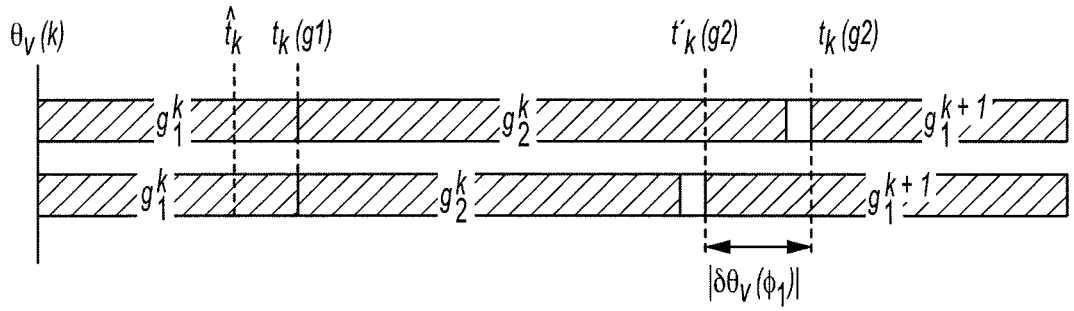
FIG. 6B is an illustration of green time split values before and after implementing a new offset value according to an embodiment of the invention.

FIG. 6B is an illustration of green time split values before and after implementing a new negative offset value according to an embodiment of the invention.

If the change in the offset time, $\delta\theta_v(\phi 1)$, is not greater than zero and the difference between the green time split value, $t_k(g2)$, and the time at which the offset value is updated, $\hat{t}_k$, then the new green time split value, $t'_k(g2)$, is implemented.

The new green time split value, $t'_k(g2)$, being equal to the old green time split value, $t_k(g2)$, minus the change in the offset time, $\delta\theta_v(\phi 1)$.

Figure 6C:
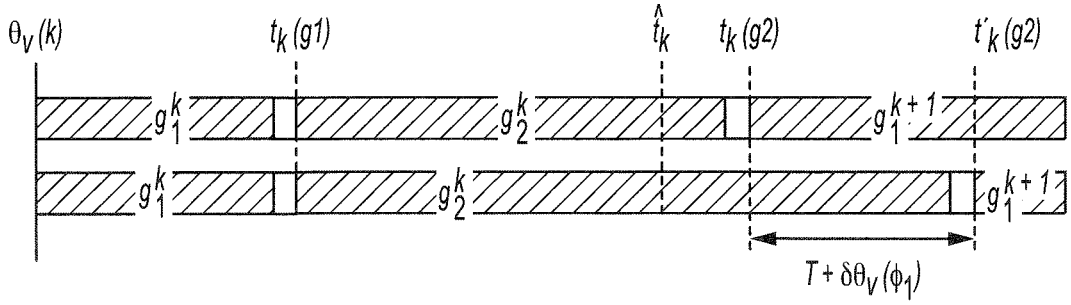
FIG. 6C is an illustration of green time split values before and after implementing a new offset value according to an embodiment of the invention.

If the change in the offset time, is larger than the cycle time, T, then the modification of the green time split value depicted in FIG. 6C is implemented.

FIG. 6C is an illustration of green time split values before and after implementing a new negative offset value according to an embodiment of the invention.

The new green time split value, $t'_k(g2)$, is modified to equal the old green time split value, $t_k(g2)$, plus the change in the offset time, $\delta\theta_v(\phi 1)$, plus the cycle T. This modification has the overall effect of increasing the green time $g_2^k$.

The foregoing description of the disclosed example embodiments is provided to enable any person of ordinary skill in the art to make or use the present invention. Various modifications to these examples will be readily apparent to those of ordinary skill in the art, and the principles disclosed herein may be applied to other examples without departing from the spirit or scope of the present invention. The described embodiments are to be considered in all respects only as illustrative and not restrictive and the scope of the invention is, therefore, indicated by the following claims rather than by the foregoing description. All changes which come within the meaning and range of equivalency of the claims are to be embraced within their scope.

What is claimed is:

1. A traffic signal controller for adaptive control of one or more traffic signals, the traffic signal controller comprising:
- a memory; and
- one or more processors operatively coupled to the memory and configured to:
  - determine an offset value based on a traffic flow performance metric;
  - determine green time split value based on a distributed algorithm;
  - control the one or more traffic signals based on the green time split value and the offset value;
  - obtain measurement data indicating the traffic flow performance metric; and
  - update at least one of the green time split value or the offset value, based on the measurement data.

2. The traffic signal controller of claim 1, wherein the one or more processors are configured to exchange determined offset values and green time split values with the one or more additional traffic signal controllers.

3. The traffic signal controller of claim 1, further comprising a transceiver configured to communicate with one or more other traffic signal controllers located diagonal from the traffic signal controller.

4. The traffic signal controller of claim 1, wherein obtaining the measurement data comprises receiving data using a Dedicated Short Range Communication (DSRC) receiver.

5. The traffic signal controller of claim 1, wherein the traffic signal controller controls more than one traffic signal.

6. The traffic signal controller of claim 1, wherein the traffic signal controller controls a network of traffic signals.

7. A method for adaptive control of one or more traffic signals comprising:
- determining an offset value based on a first traffic flow performance metric;
- determining a green time split value based on at least one of the first traffic flow performance metric or a second traffic flow performance metric;
- controlling the one or more traffic signals based on the green time split value and the offset value;
- obtaining measurement data indicating at least one of first traffic flow performance metric or the second traffic flow performance metric; and
- updating at least one of the first traffic flow performance metric or the second traffic flow performance metric, based on the measurement data.

8. The method of claim 7, further comprising calculating the green time split value based on a proportionally fair algorithm, and the offset value based on traffic queue length.

9. The method of claim 7, further comprising associating an offset value with an intersection and a traffic signal wherein the offset value is based on a degree of spill back for the associated intersection and traffic signal.

10. The method of claim 7, further comprising determining a cycle time based on the green time split value for the one or more traffic signals.

11. The method of claim 7, wherein determining the green time split value and offset value are based on an instantaneous measurement of the first traffic flow performance metric.

12. The method of claim 7, further comprising optimizing traffic flow efficiency using one or more gradients of a cost function.

13. The method of claim 7, wherein determining the green time split value occurs before determining the offset value.

14. The method of claim 7, wherein the first traffic flow performance metric comprises a distributed algorithm.

15. The method of claim 7, further comprising changing the green time split value whenever the offset value is transitioned from one value to another.

16. The method of claim 7, further comprising calculating an optimum offset value based on the combination of free flow travel time and wave speed.

17. The method of claim 7, further comprising corresponding a traffic signal controller with a traffic signal wherein the traffic signal controller is situated remotely with respect to its corresponding traffic signal.

18. The method of claim 7, further comprising providing measurement data to upstream traffic signal controllers and their associated traffic signals and updating the green time split value and offset value of the traffic signal controllers.

19. A system for adaptive control of one or more traffic signals comprising:
- a first traffic signal controller operatively coupled to a first traffic signal; and
- a second traffic signal controller operatively coupled to a second traffic signal, the second traffic signal controller configured to communicate with the first signal traffic controller, the second traffic signal controller having one or more processors configured to:
  - determine an offset value based on a traffic flow performance metric;
  - determine a green time split value based on a distributed algorithm;
  - control the one or more traffic signals based on the green time split value and the offset value;
  - obtain measurement data indicating the traffic flow performance metric; and
  - update at least one of the green time split value or the offset value, based on the measurement data.

20. The system of claim 19, wherein the one or more processors are configured to obtain measurement data over a plurality of cycle times before updating the at least one of the green time split value or the offset value.

* * * * *